US008302678B2

(12) United States Patent
Swagerty et al.

(10) Patent No.: US 8,302,678 B2
(45) **Date of Patent: *Nov. 6, 2012**

(54) FRACTURING ISOLATION SLEEVE

(75) Inventors: Gerald Brian Swagerty, Houston, TX (US); Brandon Matthew Cain, Houston, TX (US); Huy LeQuang, Houston, TX (US); Bill Albright, Houston, TX (US)

(73) Assignee: FMC Technologies Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/041,539

(22) Filed: Mar. 7, 2011

(65) Prior Publication Data

US 2011/0155367 A1 Jun. 30, 2011

Related U.S. Application Data

(63) Continuation of application No. 12/412,730, filed on Mar. 27, 2009, now Pat. No. 7,900,697, which is a continuation of application No. 11/860,215, filed on Sep. 24, 2007, now Pat. No. 7,614,448, which is a continuation of application No. 11/061,191, filed on Feb. 18, 2005, now Pat. No. 7,308,934.

(51) Int. Cl.
*E21B 33/068* (2006.01)

(52) U.S. Cl. ..... 166/177.5; 166/75.13; 166/75.14

(58) Field of Classification Search ..... 166/75.15, 166/75.13, 177.5, 381, 382, 75.14
See application file for complete search history.

(56) References Cited

U.S. PATENT DOCUMENTS

| | | | | |
|---|---|---|---|---|
| 2,074,923 | A | 3/1937 | Kitchel et al. | 285/22 |
| 2,157,964 | A | 5/1939 | Mueller | 166/15 |
| 3,186,488 | A | 6/1965 | Johnson et al. | 166/89 |
| 3,188,118 | A | 6/1965 | Jones | 285/133 |
| 3,341,227 | A | 9/1967 | Pierce, Jr. | 285/39 |
| 3,391,735 | A | 7/1968 | Schramm et al. | 166/5 |
| 3,638,722 | A | 2/1972 | Talley, Jr. | 166/5 |
| 3,799,268 | A | 3/1974 | Cochran | 166/313 |
| 4,076,079 | A | 2/1978 | Herricks et al. | 166/308 |
| 4,127,167 | A | 11/1978 | Arendt | 166/85 |
| 4,220,206 | A | 9/1980 | Van Winkle | 166/318 |
| 4,825,953 | A | 5/1989 | Wong et al. | 166/338 |
| 4,993,492 | A | 2/1991 | Cressey et al. | 166/339 |
| 5,103,900 | A | 4/1992 | McLeod et al. | 166/88 |
| 5,372,202 | A | 12/1994 | Dallas | 166/386 |

(Continued)

FOREIGN PATENT DOCUMENTS

WO WO 01/25593 A1 4/2001

OTHER PUBLICATIONS

PCT Search Report from PCT/US06/02276, dated May 14, 2007.

(Continued)

*Primary Examiner* — William P Neuder
*Assistant Examiner* — Robert E Fuller
(74) *Attorney, Agent, or Firm* — Williams, Morgan & Amerson, P.C.

(57) ABSTRACT

An apparatus operatively coupled to a well having a production casing positioned therein, the apparatus including a first device having and internal bore, a second device having an internal bore, and a fracture isolation sleeve disposed at least partially within the internal bores of the first and second devices, wherein the fracture isolation sleeve has an internal diameter that is greater than or equal to an internal diameter of the production casing.

6 Claims, 6 Drawing Sheets

U.S. PATENT DOCUMENTS

| | | | | |
|---|---|---|---|---|
| 5,390,742 | A | 2/1995 | Dines et al. | 166/297 |
| 5,605,194 | A | 2/1997 | Smith | 166/382 |
| 5,615,737 | A | 4/1997 | Ables | 166/85.4 |
| 5,785,121 | A | 7/1998 | Dallas | 166/90.1 |
| 5,819,851 | A | 10/1998 | Dallas | 166/308 |
| 5,927,403 | A | 7/1999 | Dallas | 166/77.51 |
| 5,975,211 | A | 11/1999 | Harris | 166/379 |
| 6,039,120 | A | 3/2000 | Wilkins et al. | 166/368 |
| 6,220,363 | B1 | 4/2001 | Dallas | 166/382 |
| 6,230,537 | B1 | 5/2001 | Easterbrook | 73/152.01 |
| 6,289,993 | B1 | 9/2001 | Dallas | 166/386 |
| 6,328,108 | B1 | 12/2001 | Vanderford et al. | 166/348 |
| 6,360,822 | B1 | 3/2002 | Robertson | 166/368 |
| 6,516,861 | B2 * | 2/2003 | Allen | 166/351 |
| 6,557,629 | B2 | 5/2003 | Wong et al. | 166/76.1 |
| 6,591,913 | B2 | 7/2003 | Reaux et al. | 166/352 |
| 6,609,571 | B2 | 8/2003 | Nice et al. | 166/342 |
| 6,626,245 | B1 | 9/2003 | Dallas | 166/379 |
| 6,691,775 | B2 | 2/2004 | Headworth | 166/77.2 |
| 6,712,147 | B2 | 3/2004 | Dallas | 166/379 |
| 6,817,421 | B2 | 11/2004 | Dallas | 166/379 |
| 6,817,423 | B2 | 11/2004 | Dallas | 166/382 |
| 6,823,942 | B1 | 11/2004 | McGee | 166/379 |
| 6,843,321 | B2 | 1/2005 | Carlsen | 166/355 |
| 6,920,925 | B2 | 7/2005 | Duhn et al. | 166/75.13 |
| 7,040,410 | B2 | 5/2006 | McGuire et al. | 166/379 |
| 7,114,571 | B2 | 10/2006 | Gatherar et al. | 166/367 |
| 7,308,934 | B2 * | 12/2007 | Swagerty et al. | 166/177.5 |
| 7,322,407 | B2 | 1/2008 | Duhn et al. | 166/75.14 |
| 7,416,020 | B2 | 8/2008 | Duhn et al. | 166/75.13 |
| 7,490,666 | B2 * | 2/2009 | Swagerty et al. | 166/177.5 |
| 7,614,448 | B2 * | 11/2009 | Swagerty et al. | 166/177.5 |
| 7,900,697 | B2 * | 3/2011 | Swagerty et al. | 166/177.5 |
| 2003/0024709 | A1 | 2/2003 | Cuppen | 166/382 |
| 2003/0115127 | A1 | 6/2003 | Delbarba | 166/368 |
| 2003/0205385 | A1 * | 11/2003 | Duhn et al. | 166/380 |
| 2003/0221823 | A1 | 12/2003 | Duhn et al. | 166/85.4 |
| 2003/0221838 | A1 * | 12/2003 | Dallas | 166/373 |
| 2004/0231835 | A1 | 11/2004 | Thai et al. | 166/75.13 |
| 2004/0262009 | A1 * | 12/2004 | DeBerry | 166/348 |
| 2006/0048945 | A1 * | 3/2006 | Reimert | 166/348 |
| 2007/0119595 | A1 | 5/2007 | Carlsen et al. | 166/368 |

OTHER PUBLICATIONS

Office Action dated Sep. 5, 2008 from related U.S. Appl. No. 12/102,205.
Letter dated Jan. 16, 2008 from John R. Keville to Wood Group Pressure Control, L.P. and attachments.
Letter dated Feb. 4, 2008 from John R. Keville to Ben D. Tobor.
Letter dated Feb. 19, 2008 from Ben D. Tobor to John R. Keville and attachments.
Letter dated Feb. 27, 2008 from John R. Keville to Ben D. Tobor.
Letter dated Mar. 27, 2008 from Ben D. Tobor to John R. Keville and attachments.
Letter dated Apr. 18, 2008 from John R. Keville to Ben D. Tobor.
Email dated Apr. 24, 2008 from Ben Tobor to John Keville and attachments.
Letter dated May 7, 2008 from Ben D. Tobor to John R. Keville and attachments.
Letter dated May 15, 2008 from John R. Keville to Ben D. Tobor.
Letter dated Jan. 23, 2009 from Ben D. Tobor to John R. Keville and attachments.
Letter dated Feb. 2, 2009 from John R. Keville to Ben D. Tobor.
Letter dated Feb. 14, 2008 from John R. Keville to T-3 Energy Services, Inc. and attachments.
Letter dated Feb. 27, 2008 from D. Brit Nelson to John R. Keville.
Letter dated Mar. 24, 2008 from John R. Keville to D. Brit Nelson.
Letter dated May 28, 2008 from D. Brit Nelson to John R. Keville and attachments.
FMC Drawing dated Apr. 15, 1996 entitled "Compact Two-Step Unihead".
FMC Drawing dated Oct. 30, 1987 entitled "Wellhead Layout, Thrubore".

* cited by examiner

FIG. 1
(PRIOR ART)
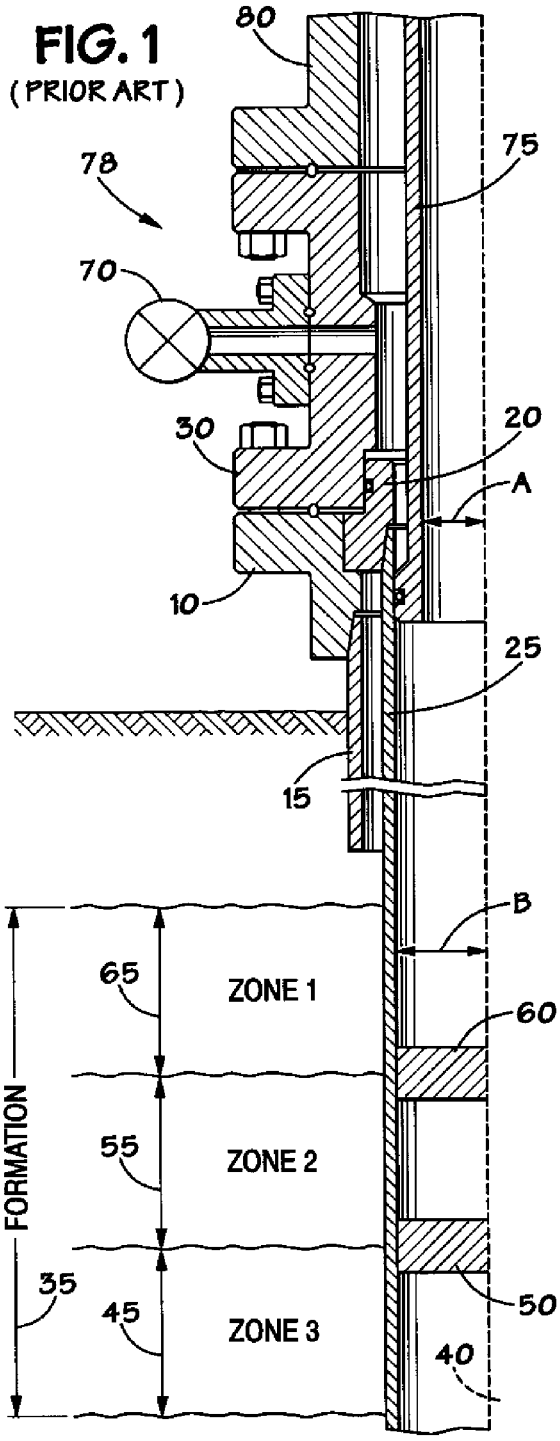
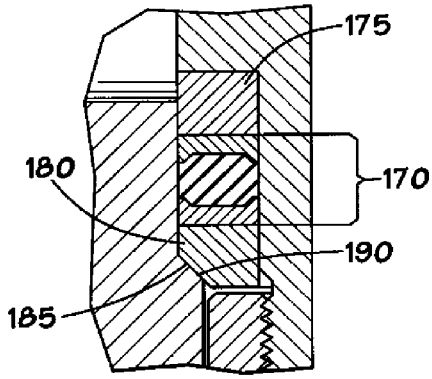
FIG. 3

FRACTURING ISOLATION SLEEVE

CROSS-REFERENCE TO RELATED APPLICATION

This is a continuation of application Ser. No. 12/412,730, filed Mar. 27, 2009, now U.S. Pat. No. 7,900,697 which was a continuation of application Ser. No. 11/860,215, filed Sep. 24, 2007, now U.S. Pat. No. 7,614,448, which was a continuation of application Ser. No. 11/061,191, filed Feb. 18, 2005, now U.S. Pat. No. 7,308,934 B2.

BACKGROUND OF THE INVENTION

1. Field of the Invention

This invention relates to a method and apparatus for isolating a portion of a wellhead during a fracturing operation.

2. Description of the Related Art

A typical oilfield well comprises several strings or tubing, such as casing strings. FIG. 1 illustrates one particular conventional well. The illustrated well includes a casing head 10 supporting an outer casing string 15. A casing hanger 20 is landed in the casing head 10 and supports an inner or production casing string 25. A tubing head 30 is disposed above the casing head 10. During normal production operations, the tubing head 30 supports a tubing hanger (not shown) and production tubing (also not shown). The production casing string 25 extends downward into a hydrocarbon bearing formation 35.

It is common in oilfield production operations to "workover" a slow producing or marginal well to stimulate and increase production. Such workover techniques may include high-pressure fracturing of the formation 35, known to the art as "fracing" a well or formation. It is also common to fracture a new well to increase the production capability of the well. Generally, in this process, a sand-bearing slurry is pumped down into the formation at very high pressures. The sand particles become embedded in small cracks and fissures in the formation, wedging them open and, thus, increasing the flow of produced fluid. Such fracturing processes are typically more efficient at lower portions of the wellbore 40.

For example, as illustrated in FIG. 1, fluid may be pumped into the production casing 25, achieving an efficient fracture of the lowest zone 45. A bridge plug 50 may then be installed above the lowest zone 45, after which the well is fractured again, achieving an efficient fracture of the middle zone 55. A second bridge plug 60 may then be installed above the middle zone 55, after which the well is once again fractured, achieving an efficient fracture of the upper zone 65. The bridge plugs 50, 60 are typically installed using a wireline lubricator. While three zones (e.g., the zones 45, 55, 65) are illustrated in FIG. 1, any number of zones may be identified in a well and any number of fracturing cycles may be performed.

The tubing head 30 and any valves associated with the tubing head, such as a valve 70 in FIG. 1, are typically rated for the expected formation pressure, i.e., the pressure of fluids produced from the well. The fracturing pressure, however, is typically much higher than the formation pressure and often exceeds the pressure rating of the tubing head and valves. Moreover, the fluids used during fracturing are often very abrasive and/or corrosive. Therefore, the tubing head 30 and other such components of the top flange connection 78 are often isolated and protected from the fracturing fluid by a wellhead isolation tool 75. A conventional wellhead isolation tool 75 mounts above a frac tree assembly 80 and comprises an elongated, tubular stab that passes through the tubing head 30 and seals to the inside surface of the production casing 25.

The fracturing fluid may then be pumped through the wellhead isolation tool 75, bypassing the tubing head 30 and frac tree assembly 80. Thus, the flange connections between the tubing head 30, the frac tree assembly 80 and tubing head annulus gate valves 70 are isolated from the pressure and the abrasive/corrosive characteristics of the fracturing fluid.

One difficulty that arises in this arrangement is that the inside diameter of the wellhead isolation tool 75 is substantially smaller than the inside diameter of the casing string 25, because the wellhead isolation tool 75 seals to the inside surface of the casing string 25. FIG. 1 illustrates the inside radius A of the wellhead isolation tool 75 is smaller than the inside radius B of the casing string 25. Since the outside diameter of the bridge plugs 50, 60 (or any downhole plug/tool), are substantially the same as the drift of the casing string 25, the bridge plugs 50, 60 cannot pass through the wellhead isolation tool 75. Therefore, each time a bridge plug 50, 60 is installed, the wellhead isolation tool 75 must be removed and the wireline lubricator installed. After installing each bridge plug 50, 60, the wireline lubricator is removed and the wellhead isolation tool 75 is reinstalled for the next fracturing cycle. This repetitive installation and removal of equipment adds significant cost and time to the management of the well.

The present invention is directed to overcoming, or at least reducing, the effects of one or more of the problems set forth above.

SUMMARY OF THE INVENTION

In one illustrative embodiment, the present invention is directed to an apparatus operatively coupled to a well having a production casing positioned therein, the apparatus including a first device having and internal bore, a second device having an internal bore, and a fracture isolation sleeve disposed at least partially within the internal bores of the first and second devices, wherein the fracture isolation sleeve has an internal diameter that is greater than or equal to an internal diameter of the production casing.

BRIEF DESCRIPTION OF THE DRAWINGS

The invention may be understood by reference to the following description taken in conjunction with the accompanying drawings, in which:

FIG. 1 is a stylized, cross-sectional view of a portion of a wellbore and a wellhead including a conventional wellhead isolation tool.

FIG. 3 is an enlarged view of a portion of the tubing head and the fracturing isolation sleeve of FIG. 2;

Figure 2:
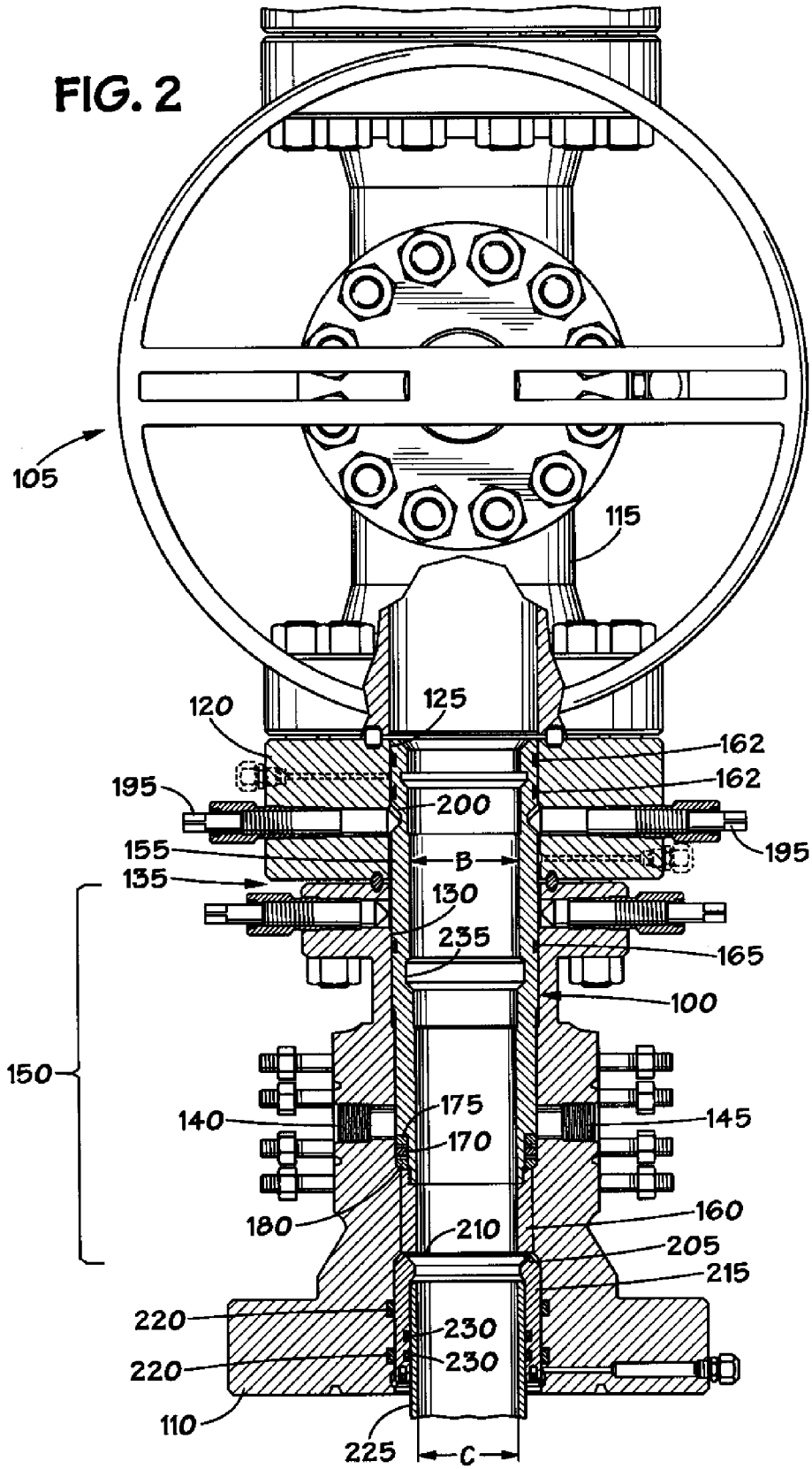
FIG. 2 is a partial cross-sectional view of an illustrative embodiment of a fracturing isolation sleeve according to the present invention disposed in a fracturing system and a tubing head.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF SPECIFIC EMBODIMENTS

Illustrative embodiments of the invention are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

The present invention, in one embodiment, is directed to a fracturing isolation sleeve adapted to isolate portions of a wellhead and is also retrievable through a fracturing tree and, if present, a blowout preventer. One particular embodiment of a fracturing isolation sleeve 100 is shown in FIG. 2. FIG. 2 illustrates a portion of a fracturing system 105, which will be discussed in greater detail below, and a tubing head 110. The components of the fracturing system 105 shown in FIG. 2 include a lower fracturing tree master valve 115 and an adapter 120, disposed between the lower fracturing tree master valve 115 and the tubing head 110. The fracturing isolation sleeve 100 is shown in FIG. 2 in an installed position, disposed in a central bore 125 of the adapter 120 and a central bore 130 of the tubing head 110. However, it should be understood that the fracture isolation sleeve of the present invention may positioned in the bores of any two devices.

When installed as shown in the embodiment of FIG. 2, the fracturing isolation sleeve 100 substantially isolates the connection between the adapter 120 and the tubing head 110 (generally at 135) from the fracturing fluid. The fracturing isolation sleeve 100 also substantially isolates ports 140, 145 defined by the tubing head 110 from the fracturing fluid. Moreover, the central bore 125 of the adapter 120 and an upper portion 150 of the central bore 130 of the tubing head 110 are substantially isolated from the fracturing fluid. In other words, the fracturing isolation sleeve 100 inhibits the fracturing fluid from contacting the upper portion 150 of the tubing head 105's central bore 130 and inhibits the fracturing fluid from contacting the central bore 125 of the adapter 120. Thus, the connection 135 between the adapter 120 and the tubing head 110, as well as the ports 140, 145, are isolated from the pressurized fracturing fluid. Note that, in general, fracturing fluid may be abrasive and/or corrosive.

Still referring to FIG. 2, the illustrated embodiment of the fracturing isolation sleeve 100 comprises a body 155 and a cap 160 threadedly engaged with the body 155. In some embodiments, however, the cap 160 may be omitted. When employed, the cap 160 may tend to minimize turbulent flow and erosion in the area adjacent the cap 160 and, for example, behind the production casing. The fracturing isolation sleeve 100 comprises one or more seals 162 (two seals 162 are shown in the illustrated embodiment) that inhibit the flow of fluid between the fracturing isolation sleeve 100 and the adapter 120. The fracturing isolation sleeve 100 further comprises seals 165, 170 that inhibit the flow of fluid between the fracturing isolation sleeve 100 and the tubing head 110. In the illustrated embodiment, the seals 162, 165 may comprise elastomeric and/or metallic seals known to the art. However, it should be understood that the fracture isolation sleeve may be sealed between any two components. For example, the fracture isolation sleeve may be of sufficient length such that one end of the sleeve is sealed against the tubing head 110 while the other end of the sleeve extends up through the valve 115 and is sealed within an internal bore within a Christmas tree (not shown) positioned above the valve 115. In such a configuration, the sleeve may be employed to protect the lower master valve 115 from erosion during fracturing operations.

The seal 170, in the illustrated embodiment, comprises compression packing that prior to compression, has a smaller diameter than the central bore 125 of the adapter 120 and the central bore 130 of the tubing head 110. Disposed above and below the compression seal 170 are spacers 175, 180, respectively, that are used to change the position of the compression seal 170 with respect to the body 155 of the fracturing isolation sleeve 100. Note that different tubing heads 110 may have ports 140, 145 located in different positions. For example, one tubing head 110 may have ports 140, 145 located slightly above the ports 140, 145 of another tubing head. The spacers 175, 180 may be chosen from a selection of different length spacers 175, 180 so that the compression seal 170 is disposed below the ports 140, 145, thus ensuring they are substantially isolated from the fracturing fluid. Alternatively, the spacers 175, 180 may be sized for a particular tubing head 110, such that the tubing head 110's ports are isolated from the fracturing fluid.

FIG. 3 provides an enlarged, cross-sectional view of the compression seal 170, the spacers 175, 180, and a portion of the tubing head 110. The spacer 180 defines a shoulder 185 corresponding to a load shoulder 190 defined by the tubing head 110. When the fracturing isolation sleeve 100 is landed in the tubing head 110, the shoulder 185 of the spacer 180 is disposed on the shoulder 190 of the tubing head 110. The adapter 120 comprises lockdown screws 195 (shown in FIG. 2) that engage a chamfered groove 200 defined by the fracturing isolation sleeve 100. The lockdown screws 195 have chamfered ends that engage the chamfered surface of the groove 200 such that, as the screws are tightened, the fracturing isolation sleeve 100 is urged downwardly (as depicted in FIG. 2). When the shoulder 185 of the spacer 180 is in contact with the load shoulder 190 of the tubing head 110, further tightening of the lockdown screws 195 cause the compression seal 170 to be compressed axially and expand radially to seal between the body 155 of the fracturing isolation sleeve 100 and the central bore 130 of the tubing head 110.

Referring again to the embodiment of FIG. 2, the cap 160 is sized such that, when installed, its lower surface 205 is disposed adjacent an upper surface 210 of a production casing bushing 215. The bushing 215 is sealed to the tubing head 110 via seals 220 and to a production casing 225 via seals 230, which are known to the art. While, in this embodiment, the cap 160 is not sealed to the bushing 215, it provides protection for the portion of the central bore 130 of the tubing head 110 adjacent thereto by inhibiting turbulent flow of the fracturing fluid to contact that portion of the central bore 130.

Figure 4:
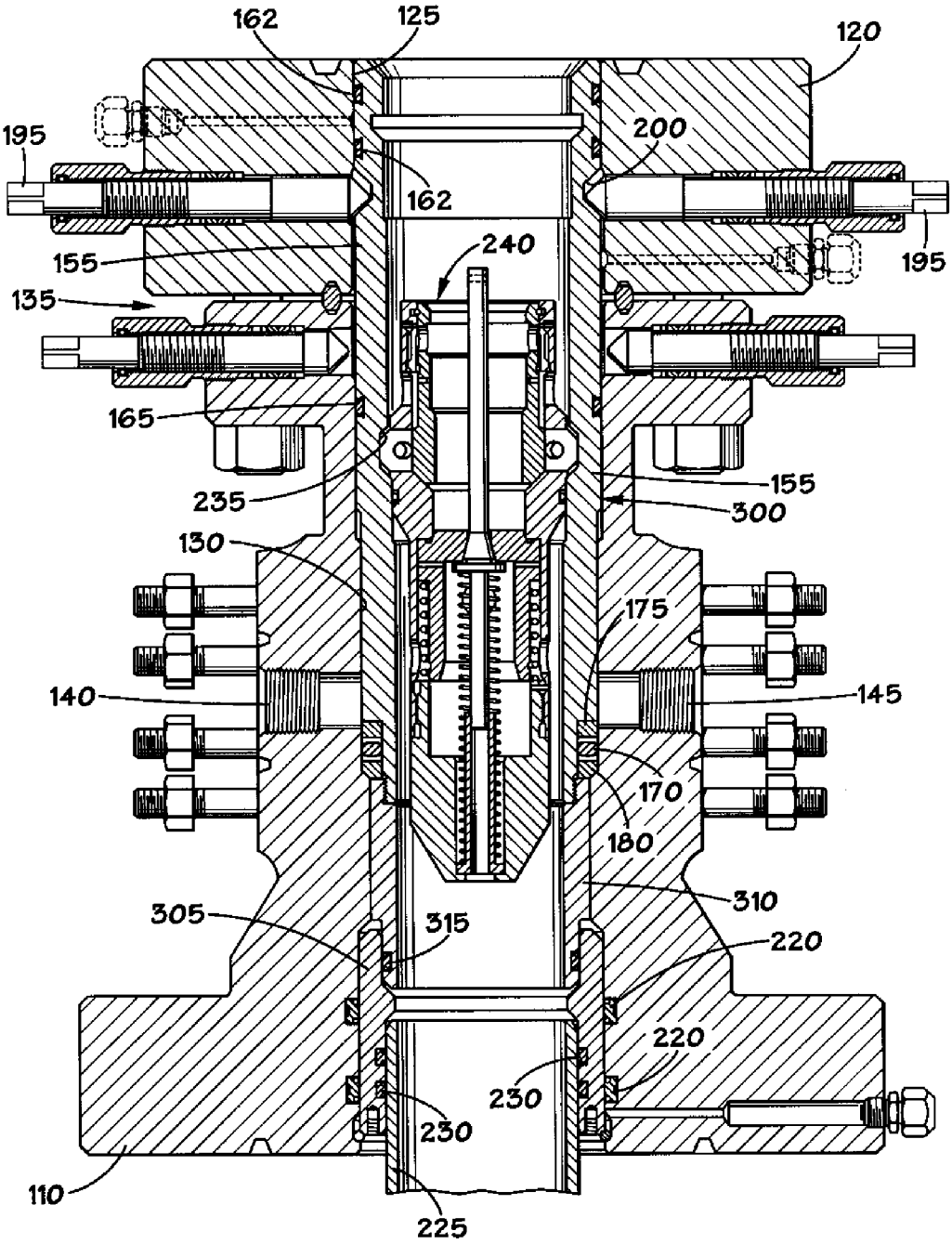
FIG. 4 is a partial cross-sectional view of an illustrative embodiment of a fracturing isolation sleeve according to the present invention alternative to that of FIG. 2 disposed in a fracturing system and a tubing head.

Alternatively, as shown in the illustrative embodiment of FIG. 4, a fracturing isolation sleeve 300 may be sealed with a production casing bushing 305. In this embodiment, the fracturing isolation sleeve 300 comprises a cap 310 that includes a seal 315 that sealingly engage the bushing 305. In this way, the tubing head 110 is substantially isolated from the pressure and the corrosive/abrasive characteristics of the pressurized fracturing fluid. Note that the scope of the present invention encompasses a plurality of seals, such as the seal 315, for sealing the cap 310 to the bushing 305. The bushing 305 is sealed with respect to the tubing head 110 and with respect to the production casing 225 as discussed above concerning the embodiment of FIG. 2. Other aspects of this illustrative embodiment of the fracturing isolation sleeve 300 generally correspond to those of the embodiment shown in FIG. 2.

Figure 5:
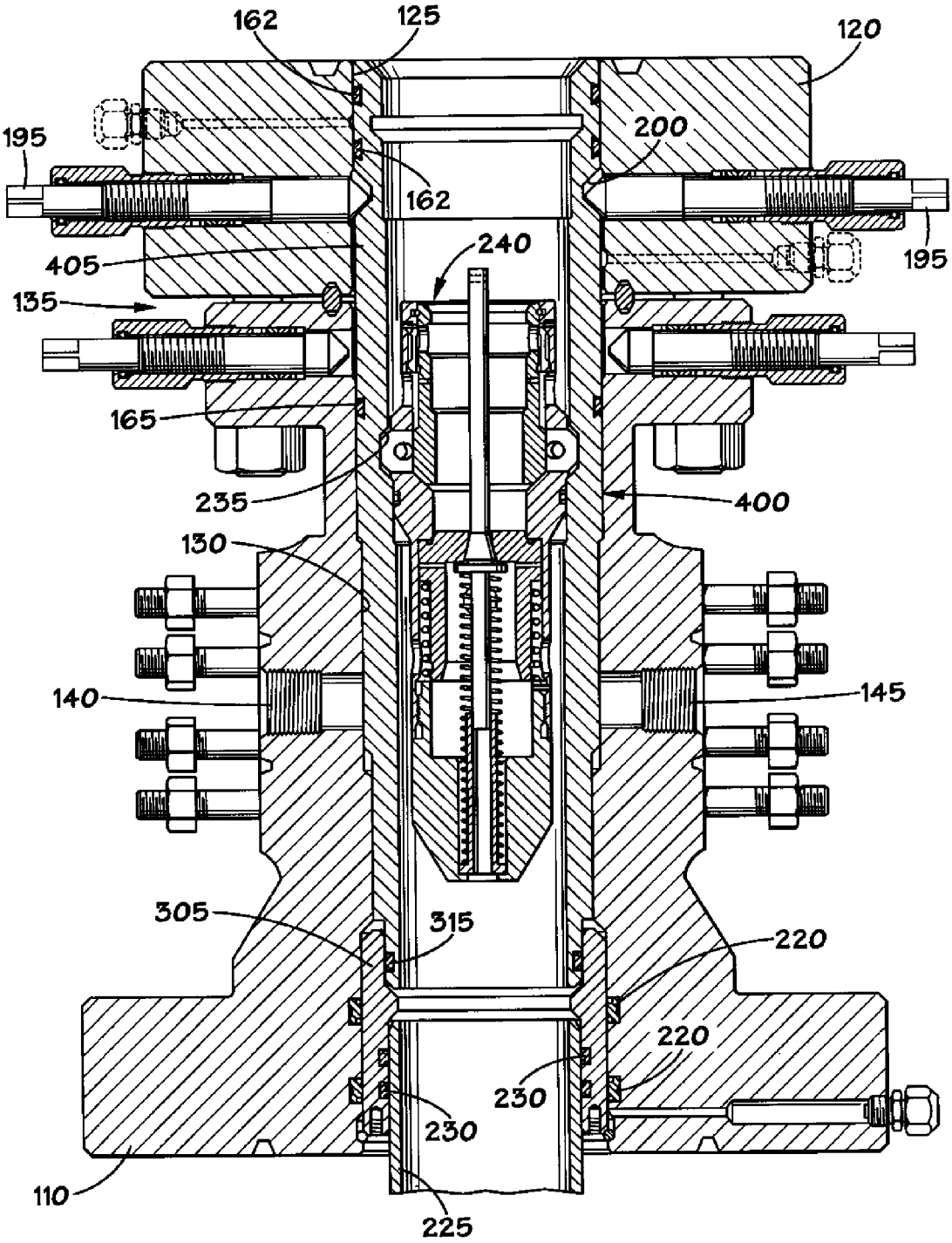
FIG. 5 is a partial cross-sectional view of an illustrative embodiment of a fracturing isolation sleeve according to the present invention alternative to that of FIGS. 2 and 4 disposed in a fracturing system and a tubing head.

FIG. 5 depicts another alternative embodiment of a fracturing isolation sleeve according to the present invention. This illustrative embodiment corresponds generally to the embodiment of FIG. 4, except that the compression seal 170, the spacers 175, 180, and the cap 310 have been omitted. In this embodiment, a fracturing isolation sleeve 400 comprises a body 405 adapted to seal directly to the bushing 305 via seal 315. Note that, alternatively, the fracturing isolation sleeve 400 could comprise the body 155, omitting the compression seal 170 and the spacers 175, 180, including the cap 310 threadedly engaged with the body 155.

Note that in the illustrative embodiments of FIGS. 2, 4, and 5, the fracturing isolation sleeves 100, 300, 400 have internal diameters that are no smaller than that of the production casing 225. As illustrated in FIG. 2, the inside diameter B of the fracturing isolation sleeve 100 is at least as large as the inside diameter C of the production casing 225. Accordingly, the bridge plugs 50, 60 (shown in FIG. 1) may be installed through the fracturing isolation sleeve 100, rather than having to remove a wellhead isolation tool or the like prior to installing the bridge plugs 50, 60. Further, the wireline lubricator (not shown), used to install the bridge plugs 50, 60, may remain in place during the entire fracturing process, as the fracturing isolation sleeve 100 remains installed during the entire fracturing process.

Figure 6:
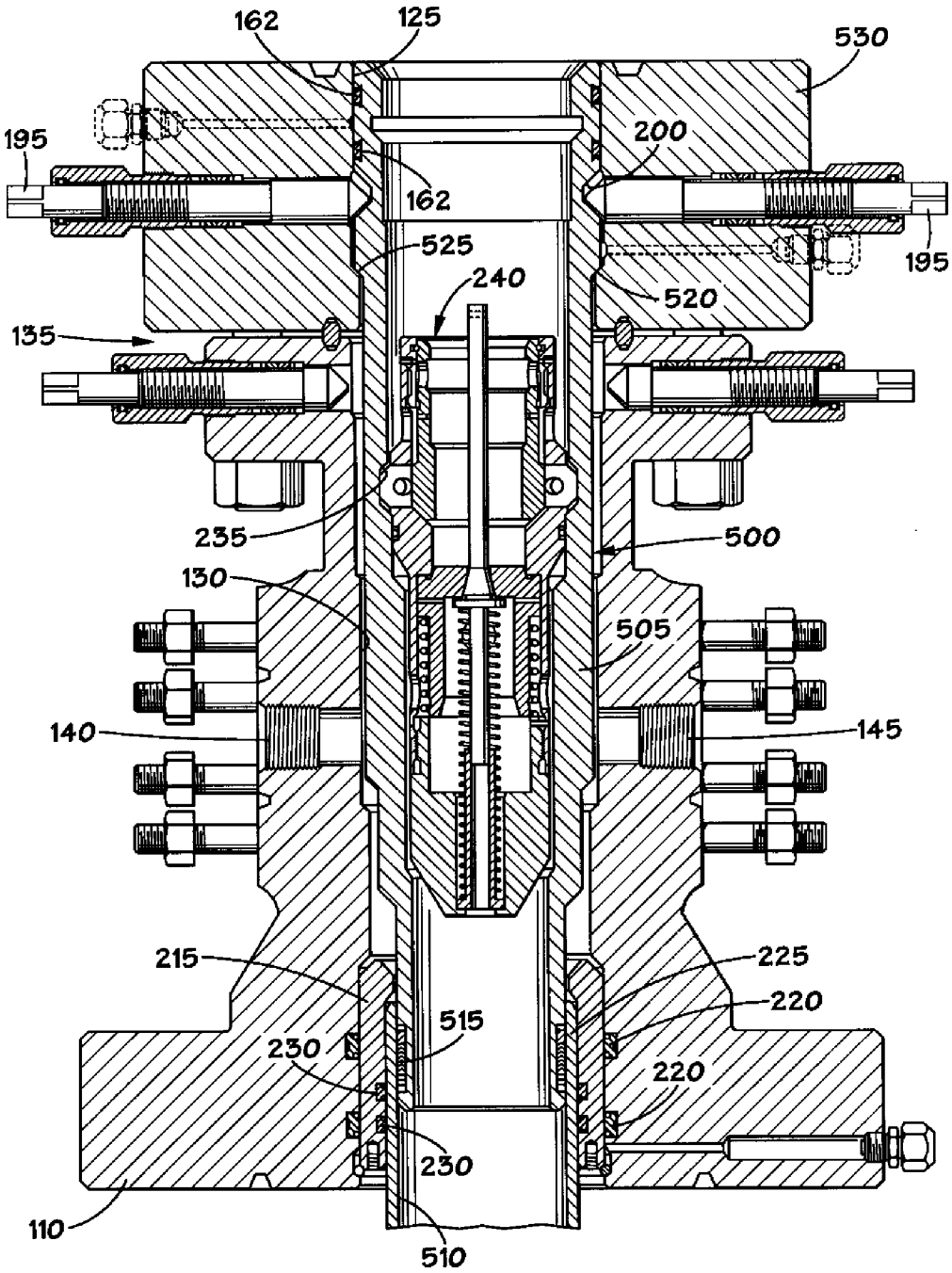
FIG. 6 is a partial cross-sectional view of an illustrative embodiment of a fracturing isolation sleeve according to the present invention alternative to that of FIGS. 2, 4, and 5 disposed in a fracturing system and a tubing head.

FIG. 6 depicts yet another alternative embodiment of a fracturing isolation sleeve according to the present invention. In this embodiment, a fracturing isolation sleeve 500 comprises a body 505 adapted to seal against an internal surface 510 of the production casing 225 via a seal assembly 515. While the present invention is not so limited, the seal assembly 515 in the illustrated embodiment comprises a stacked assembly of V-ring seal elements, as disclosed in commonly-owned U.S. Pat. No. 4,576,385 to Ungchusri et al., which is hereby incorporated by reference for all purposes. The body 505 defines a shoulder 520 that, when installed, is disposed against a load shoulder 525 defined by the adapter 530. Thus, the fracturing isolation sleeve 500 may be used in various implementations, irrespective of the features of the tubing head 110.

Note that, in an alternative embodiment, the embodiments of FIG. 5 may be modified to include a shoulder, such as the shoulder 520 of FIG. 6, that can be disposed against the load shoulder 525 of the adapter 530. As in the embodiment of FIG. 6, such a fracturing isolation sleeve may be used in various implementations, irrespective of the features of the tubing head 110. That is, the embodiment of the fracture sleeve depicted in FIG. 6 may be employed with a variety of different tubing heads having a variety of different configurations.

The valves of the fracturing system 105 (e.g., the lower fracturing tree master valve 115) provide a primary safety barrier to undesirable flow through the internal bore of the fracturing isolation sleeves 100, 300, 400, 500. It is often desirable, however, to provide a second safety barrier to such undesirable flow. Accordingly, the embodiments of the fracturing isolation sleeves 100, 300, 400, 500 may define one or more profiles 235 adapted to seal with a check valve 240 (e.g., a back pressure valve, a tree test plug, or the like), shown in FIGS. 4, 5, and 6. Such check valves 240 are known to the art. When employed, the valve 240 may serve as a secondary pressure barrier against downhole pressure (the lower master valve 115 would constitute the other pressure barrier).

The fracturing isolation sleeves 100, 300, 400, 500 and the check valve 240 can be removed at any time, even while the fracturing system 105 is under pressure, through the fracturing system 105 or a blow-out preventer (not shown), if present, without the need to shut-in the well. In the illustrative embodiment depicted in FIG. 7, this may be accomplished as follows. After fracturing has occurred and the well begins to flow, it may be desirable to let the well flow for a day of two to remove the grit and debris associated with fracturing operations. In allowing the well to flow, the valve 100A is open, the valve 100B is closed and the valve 115 is closed. After the well has flowed for a sufficient period of time, it may be desirable to remove the fracture isolation sleeve without shutting-in the well. To accomplish this, the well cap 100C may be removed and a lubricator (not shown) may be operatively coupled to the system. Thereafter, the valve 115 may be opened and the lubricator may be extended to engage an inner profile on the fracture isolation sleeve. Thereafter, the lock-down screws 195 may be disengaged from the fracture sleeve and the lubricator can retract the fracture isolation sleeve up past the valve 15 which is then closed. The pressure above the valve 115 may then be vented. At that point the lubricator may be removed and the well cap 100C may be re-installed. Note that during this process the well continues to flow.

Figure 7:
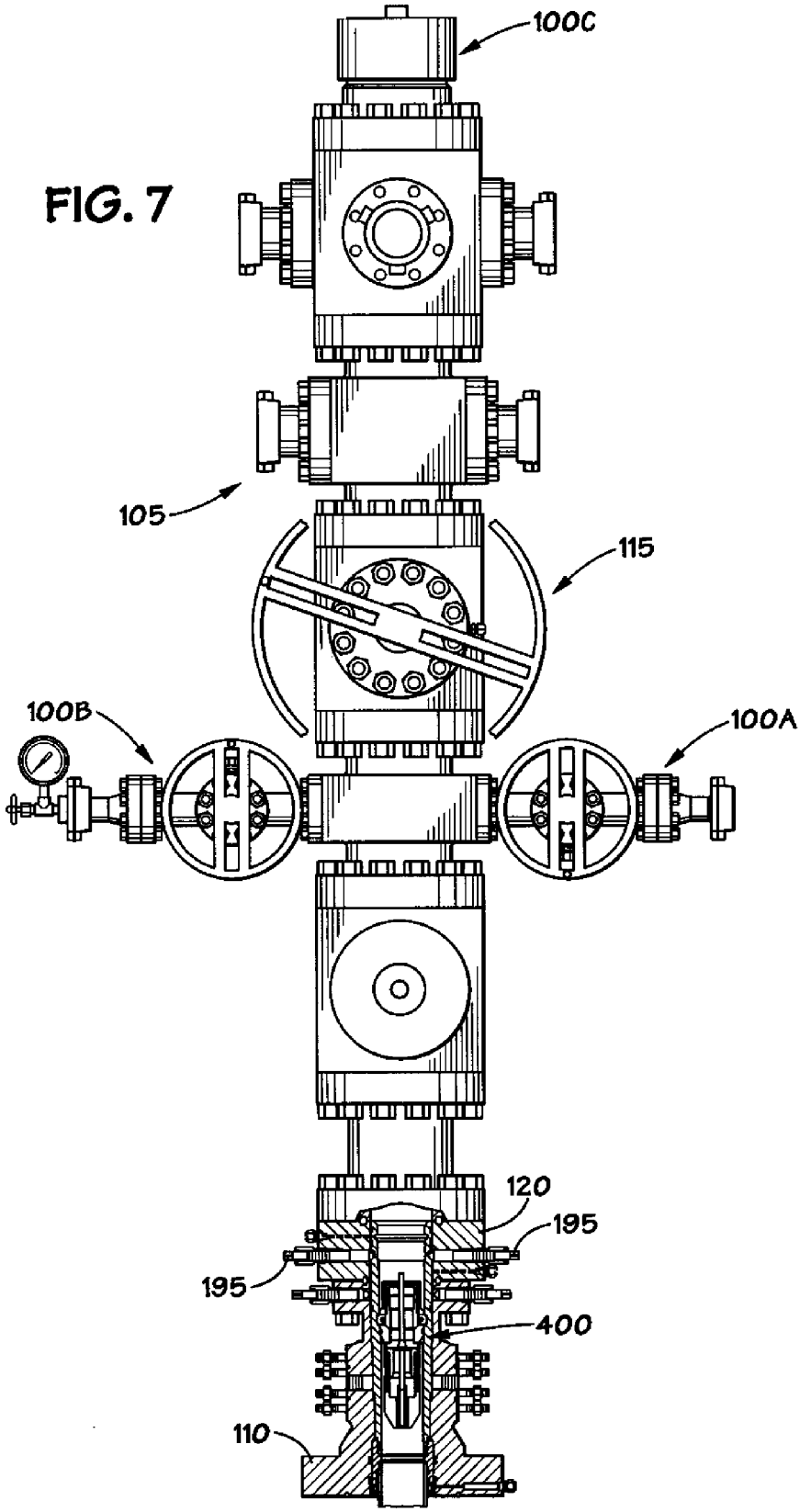
FIG. 7 is a side, elevational view of an illustrative embodiment of a fracturing system according to the present invention.

It is generally desirable to use equipment having pressure ratings that are equal to or only slightly greater than the pressures expected during a downhole operation because higher pressure-rated equipment is generally costlier to purchase and maintain than lower pressure-rated equipment. FIG. 7 depicts one illustrative embodiment of a fracturing system 600 installed on the tubing head 110. In this embodiment, the elements of the fracturing system 600 above the adapter 120 are rated at or above the fracturing pressure, which is typically within a range of about 7,000 pounds per square inch to about 9,000 pounds per square inch. The tubing head 110 is rated for production pressure, which is typically less than 5,000 pounds per square inch and, thus, less than the fracturing pressure. For example, the elements above the adapter 120 may be rated for 10,000 pounds per square inch maximum pressure, while the tubing head 110 is rated for 5,000 pounds per square inch maximum pressure. This arrangement is particularly desirable, because the tubing head 110 is used prior to and following fracturing, while the elements of the fracturing system 105 are used only during fracturing and are often rented. The tubing head 110 may be rated at a lower pressure than the fracturing pressure because it is isolated from the fracturing pressure by one of the fracturing isolation sleeves 100, 300, 400, 500. Note that while FIG. 7 illustrates the fracturing isolation sleeve 400 of FIG. 5, any fracturing isolation sleeve (e.g., the sleeves 100, 300, 500) according to the present invention may provide this benefit. The fracture isolation sleeves 100, 300, 400 and 500 disclosed herein may also be retrieved through a production tree and BOP 9blowout preventer) with and without wellhead pressure conditions existing.

The present invention also encompasses the use of elements of the fracturing system 105 disposed above the adapter 120 that are also rated only to production pressures, rather than to fracturing pressures. In such embodiments, for example, seals used in the fracturing system 105 are rated to at least the fracturing pressure, while the valve bodies, etc. are only rated to production pressures. In one example, the seals of the fracturing system 105 are rated to 10,000 pounds per square inch, while other components of the fracturing system 105 are rated to 5,000 pounds per square inch.

This concludes the detailed description. The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed is:

1. An apparatus adapted to be operatively coupled to a well having a production casing positioned therein, the apparatus comprising:

a first device having an internal bore;

a second device having an internal bore;

a fracture isolation sleeve disposed at least partially within said internal bores of said first and second devices, said fracture isolation sleeve having an internal diameter that is greater than or equal to an internal diameter of said production casing, wherein an end of said fracture isolation sleeve is adapted to sealingly engage a production casing bushing in said well, and wherein at least a portion of said production casing bushing is positioned in said second device;

a first seal between said internal bore of said first device and said fracture isolation sleeve;

a second seal between said fracture isolation sleeve and said production casing bushing; and a profile formed in an outer surface of said fracture isolation sleeve, wherein said profile is adapted to be engaged to secure said fracture isolation sleeve in an operational position and wherein said profile in said outer surface of said fracture isolation sleeve is adapted to be engaged by a lock down screw.

2. The apparatus of claim 1, wherein said fracture isolation sleeve is adapted to be retrievable through at least one device positioned above said first device.

3. The apparatus of claim 1, wherein said first and second devices are adapted to be positioned adjacent to one another and coupled together.

4. The apparatus of claim 1, wherein said first and second devices are adapted to be positioned spaced apart from one another and not coupled to each other.

5. The apparatus of claim 1, wherein said first device comprises at least one of a adapter and a Christmas tree.

6. The apparatus of claim 1, wherein said second device comprises a tubing head.

* * * * *